United States Patent [19]

Eguchi et al.

[11] Patent Number: 4,834,891

[45] Date of Patent: May 30, 1989

[54] LUBRICANT COMPOSITIONS FOR METALWORKING

[75] Inventors: Kiyohisa Eguchi, Kawanishi; Norio Kitamura, Itami; Terumasa Okamura, Kashiwa; Jouji Ohta, Ikoma, all of Japan

[73] Assignees: Director-General of Agency of Industrial Science & Technology, Tokyo; Taihei Chemical Industrial Co., Ltd., Osaka; Hanano Commercial Co., Ltd., Kobe; Kabushiki Kaisha Gosei Kagaku Kenkyusho, Tokyo, all of Japan

[21] Appl. No.: 87,353

[22] Filed: Aug. 20, 1987

Related U.S. Application Data

[63] Continuation-in-part of Ser. No. 939,301, Dec. 5, 1986, abandoned, which is a continuation of Ser. No. 824,827, Jan. 31, 1986, abandoned, which is a continuation of Ser. No. 621,829, Jun. 18, 1984, abandoned.

[30] Foreign Application Priority Data

Jun. 17, 1983 [JP] Japan ..... 58-109828

[51] Int. Cl.[4] ..... C10M 125/10

[52] U.S. Cl. ..... 252/28; 72/42; 252/41; 252/49.6

[58] Field of Search ..... 252/28, 41, 49.6; 72/42.1, 42

[56] References Cited

U.S. PATENT DOCUMENTS

| | | | |
|---|---|---|---|
| 2,874,121 | 2/1959 | Hatton | 252/39 |
| 3,298,953 | 1/1967 | Marway | 252/41 |
| 3,840,461 | 10/1974 | Espunes | 252/28 |
| 4,260,498 | 4/1981 | Sample, Jr. et al. | 252/28 |
| 4,402,838 | 9/1983 | Eguchi et al. | 252/28 |
| 4,409,113 | 10/1983 | Bertell | 252/49.3 |
| 2,904,930 | 6/1960 | Pattenden | 252/41 |

OTHER PUBLICATIONS

Smalheer et al, "Lubricant Additives," 1967, pp. 7–8.

*Primary Examiner*—William R. Dixon, Jr.
*Assistant Examiner*—Margaret B. Medley
*Attorney, Agent, or Firm*—Armstrong, Nikaido, Marmelstein & Kubovcik

[57] ABSTRACT

The present invention provides a lubricant composition for metalworking at a temperature higher than 200° C. which comprises as its active components (i) at least one alkali metal salts of phthalic acid and (ii) a glass composition comprising 20 to 70% by weight of $P_2O_5$, 8 to 72% by weight of $M_2O$ wherein M is an alkali metal and 0 to 80% by weight of $B_2O_3$, the ratio of component (i) to component (ii) being about 10:90 to about 90:10 in a total amount of 100 parts by weight.

9 Claims, 3 Drawing Sheets

LUBRICANT COMPOSITIONS FOR METALWORKING

Figure 1:
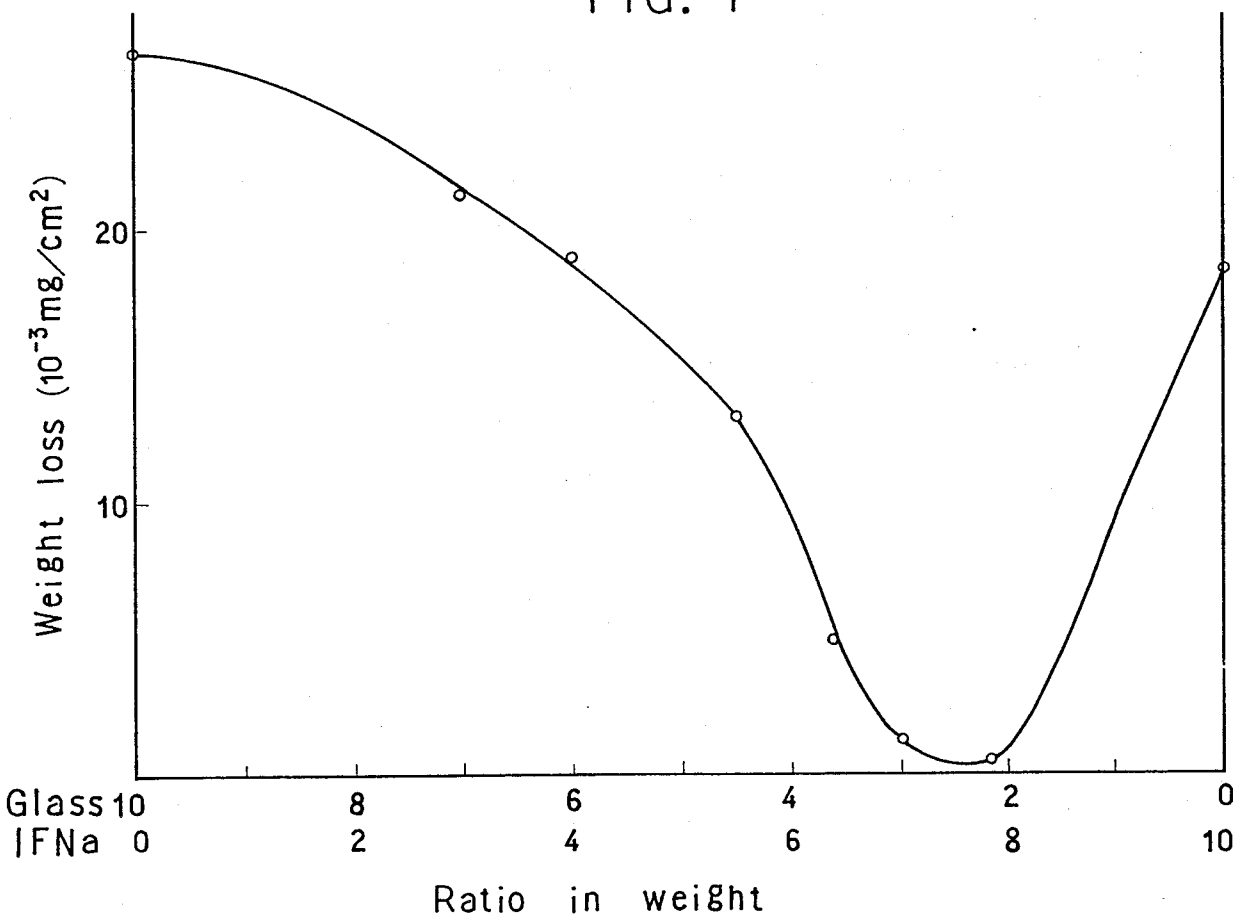

This application is a continuation-in-part of pending application Ser. No. 939,301 filed 12/05/86 which is a continuation of abandoned application Ser. No. 824,827, filed 01/31/86 which is a continuation of abandoned application Ser. No. 621,829 filed 12/18/86.

This invention relates to lubricant compositions for metalworking and more particularly to lubricant compositions for warm-working or hot-working, especially for forging, extrusion and die casting or like casting.

Lubricants are usually used in warm-working and hot-working and are roughly classified into oil soluble and water soluble lubricants. The oil soluble lubricants comprise graphite, mineral oil or wax and, when required, extreme pressure agent and emulsifier, and pose environmental and operation problems of involving fire hazards and giving off fumes and malodors. The water soluble lubricants, which contain graphite and water as the main components, are likely to soil the machine and operator because of the graphite contained and remain to be improved in respect of environmental defects, although comparable with the oil soluble lubricants in lubricity and ability to release shaped articles from the die (releasability). The water soluble lubricants have further drawbacks of tending to cause clogging in the spray nozzle which impedes automatic operation and to electrolytically corrode the piping.

We have been pursuing extensive research for long to overcome the foregoing drawbacks of conventional lubricants. In the course of the research, we found first that a glass composition comprising 56.8 to 78.1% by weight of $P_2O_5$, 4.18 to 6.26% by weight of $B_2O_3$ and 8.96 to 56.5% by weight of $M_2O$ (M=alkali metal) is soluble in water and has a good lubricity, hence significantly suitable as the lubricant for metalworking. Then we filed two applications in Japan for patents of this discovery which matured to Japanese Examined Patent Publications Nos. 7976/1981 and 17297/1981. Our continued research revealed that when the above-mentioned glass composition is used conjointly with a phyllosilicate, the resulting composition has a synergistically outstanding lubricity, and we applied for a patent of the result (Japanese Unexamined Patent Publication No. 73089/1982). Thereafter we further continued the research and discovered the following:

(a) Alkali metal salts of phthalic acid and benzoic acid exhibit an excellent lubricity in metalworking with a low degree of processing. However, these salts have drawbacks: they are corrosive to metals forming molds and show a very poor lubricity in metalworking with a high degree of processing.

(b) When the alkali metal salt of phthalic acid is used conjointly with a specific glass composition, the resulting mixture synergistically gives higher lubricity and shows markedly lower corrosiveness than the alkali metal salt in (a).

(c) The lubricant comprising alkali metal salt of phthalic acid and a specific glass composition exhibits a remarkable lubricity, releasability and reduced corrosiveness even in casting, forging and like metalworking processes with a high degree of processing.

Based on these novel findings, the present invention has been accomplished. The present invention provides a lubricant composition for metalworking at a temperature higher than 200° C. which comprises as its active components (i) at least one alkali metal salt of phthalic acid and (ii) a glass composition comprising 20 to 70% by weight of $P_2O_5$, 8 to 80% by weight of $M_2O$ wherein M is an alkali metal and 0 to 72% by weight of $B_2O_3$, the ratio of component (i) to component (ii) being 10:90 to 90:10 in a total amount of 100 parts by weight.

Alkali metal salts of phthalic acids which can be used in the present invention are alkali metal salts of phthalic acid, isophthalic acid, terephthalic acid and orthophthalic acid. Useful alkali metals in the salts are sodium, potassium, lithium, etc. among which sodium is preferred. These alkali metal salts can be used singly or at least two of them are usable in admixture.

The glass composition to be used in the present invention comprises 20 to 70% by weight of $P_2O_5$, 8 to 80% by weight of $M_2O$ (M=alkali metal) and 0 to 72% by weight of $B_2O_3$, and is soluble in water. While certain of the glass compositions in the range as specified above have a good lubricity themselves (Japanese Examined Patent Publications Nos. 7976/1981 and 17297/1981), a glass composition selected over such broad range is used, according to the present invention, conjointly with the alkali metal salt of phthalic acid specified above to produce a lubricant having a synergistically increased lubricity, releasability and markedly reduced corrosiveness.

The present invention involves the use of the glass composition comprising 20 to 70% by weight, preferably 55 to 65% by weight, of $P_2O_5$, 8 to 80% by weight, preferably 25 to 45% by weight, of $M_2O$ (M=alkali metal) and 0 to 72% by weight, preferably 3 to 7% by weight, of $B_2O_3$. The glass composition to be used has a suitable viscosity of hundreds to thousands of poises at a temperature of 200° to 800° C. at which it is used for extrusion, casting or forging. If the proportions of $P_2O_5$, $B_2O_3$ and $M_2O$ are outside the foregoing respective ranges, the glass composition fails to have a suitable viscosity at 200° to 800° C. and therefore to exhibit a high lubricity which is essential to lubricants, hence undesirable.

The glass composition to be used in the present invention can be prepared from a wide variety of materials which are commonly used in the art. Usable as $P_2O_5$ sources are phosphoric acid, sodium primary phosphate, potassium primary phosphate, sodium secondary phosphate, potassium secondary phosphate, sodium metaphosphate, potassium metaphosphate, sodium polyphosphate, potassium polyphosphate and like phosphates. Boric acid, sodium borate, potassium borate and like borates are usable as the $B_2O_3$ sources. Examples of useful $M_2O$ sources are sodium carbonate, potassium carbonate and like carbonates, sodium nitrate, potassium nitrate and like nitrates, sodium sulfate, potassium sulfate and like sulfates, sodium hydroxide, potassium hydroxide and like hydroxides, etc.

The glass composition employed in the present invention is used as it is or as dissolved in water. It is preferred to use the glass composition in the form of powder. For use in the form of an aqueous solution, the glass composition is dissolved in water. The ratio of the glass composition to water is not particularly limited but widely variable. Usually the aqueous glass solution has a concentration of 2 to 60% by weight, preferably 20 to 50% by weight. The aqueous solution can be prepared easily merely by admixing the glass composition with water and stirring the mixture at room temperature.

Usually a concentrated solution is prepared, which is diluted with a suitable amount of water before use.

The term glass composition used in the specification and the appended claims includes a mixture of materials which will form the glass compositions in the foregoing range. In this case, a material usable as the $P_2O_5$ source, a material serving as the $B_2O_3$ source and a material serving as the $M_2O$ source are mixed together in such proportions that the resulting mixture, when vitrified, contains 20 to 70% by weight of $P_2O_5$, 0 to 72% by weight of $B_2O_3$ and 8 to 80% by weight of $M_2O$. The mixture is used at it is or in the form of an aqueous solution. When the mixture or solution further including alkali metal salt of phthalic acid is applied to a die heated at about 200° to about 800° C. for forging, casting or extrusion, the mixture is melted by the heat and easily vitrified, or the solution is similarly vitrified on evaporation of the water.

According to the present invention, the glass composition and the alkali metal salt of phthalic acid are conjointly used in a ratio of about 10 to about 90 parts by weight of the former to about 90 to about 10 parts by weight of the latter in a total amount of 100 parts by weight. Generally with the increase in the amount of the glass composition, the friction coefficient involved tends to decrease but the die is likely to corrode to an impaired degree, whereas the increase in the amount of the alkali metal salt leads to lesser degree of corrosion in the die but to the deterioration of the friction coefficient. When the two components are used in a ratio of about 10 to about 40 parts by weight of the glass composition and about 90 to about 60 parts by weight of the alkali metal salt per 100 parts by weight of the total amount of the two components, the friction coefficient and the amount of corrosion in the die are particularly well balanced and an especially improved releasability results.

An adhesive material can be added to the present lubricant composition to render the composition more sticky to the die at a broad temperature range, particularly at low temperatures. Useful adhesive materials are those having adhesiveness themselves. Generally used as such adhesive materials are water soluble or water dispersible high-molecular-weight materials. Examples of the adhesive materials are alginates, starches, rubbers, polyvinyl alcohols, polyacrylates, vinyl acetates, celluloses, etc. The high-molecular-weight material is used in an amount of 0 to about 30 parts by weight, preferably about 2 to about 10 parts by weight, per 100 parts by weight of the alkali metal salt of phthalic acid.

The lubricant compositions of the present invention can be in the form of a powder, aqueous solution or dispersion. The concentration of the solution or dispersion is not particularly limited and usually ranges from about 5 to about 40% by weight. The solution or dispersion having such concentration can be used as it is or is generally diluted with water up to about 50-fold before use. To use the lubricant composition of the present invention, the composition is applied to dies for metalworking, especially forging, casting or extrusion by a suitable method such as coating, spraying, immersion, etc.

Metalworking processes for which the present lubricant compositions can be used are various and include rolling, forging, casting, extrusion and the like among which forging, casting and extrusion with a high degree of processing are preferable to use the present lubricant compositions because they exhibit remarkable lubricity, releasability and low corrosiveness even at high temperatures between about 200° C. and about 800° C. Metals to be used in the metalworking processes involving the use of the present lubricant compositions include a wide range such as copper, aluminium, iron, steel, brass and like alloys, etc.

The present invention will be described below in more detail with reference to the following Examples.

EXAMPLE 1

Phosphoric acid, sodium carbonate, potassium carbonate and boric acid were mixed together in proportions, calculated as oxides, of 58.8% by weight of $P_2O_5$, 5% by weight of $B_2O_3$, 24% by weight of $Na_2O$ and 11.5% by weight of $K_2O$, and the mixture was heated at 900° C. for 30 minutes for melting and vitrified. The glass was dissolved in water to produce an aqueous solution having a concentration of 30% by weight. Aside from the preparation of the above solution, an aqueous solution of sodium isophthalate (IFNa) having a concentration of 20% by weight and an aqueous solution of polyvinyl alcohol having a concentration of 10% by weight were prepared.

The three aqueous solutions thus produced were mixed together in various ratios listed below in Table 1 to obtain lubricant compositions. The lubricant compositions thus obtained were tested for properties under the following conditions.

A square plate (40 mm in length and width and 10 mm in thickness) made of a steel alloy (SKD-61) was used as a test sample. Tests were conducted in the manner as described hereinafter by use of eight kinds of lubricant compositions shown below in Table 1. The test sample was placed on an iron plate heated to 400° C. by a burner and indirectly heated thereon. The surface of the test sample was polished before each application of the lubricant compositions with sandpaper (cc1000-cw). Each composition (5% by weight of solid content) was applied by a brush to the test sample with its surface at 180° to 200° C. Then the test sample was heated to 300° C., immersed in water to chill the surface and heated again in hot water having a temperature of 100° C. for 30 minutes. The composition was applied to an area of 13.85 $cm^2$ on the test sample.

TABLE 1

| No. | 1 | 2 | 3 | 4 | 5 | 6 | 7 | 8 |
|---|---|---|---|---|---|---|---|---|
| Glass | 100 | 70 | 60 | 55 | 44 | 30 | 22 | 0 |
| Sodium isophthalate | 0 | 30 | 40 | 45 | 56 | 70 | 78 | 100 |
| Polyvinyl alcohol | 4 | 4 | 4 | 4 | 4 | 4 | 4 | 4 |
| Dilution (fold) | 20 | 20 | 20 | 20 | 20 | 20 | 20 | 20 |

Table 1 indicates the materials as used in terms of part by weight, calculated as solids.

FIG. 1 shows that in terms of corrosion of the the metal, markedly improved results were produced by the lubricant composition comprising 10 to 40% by weight of the glass composition and 90 to 60% by weight of sodium isophthalate.

EXAMPLE 2

The lubricant compositions Nos. 1-8 obtained in Example 1 was tested for friction coefficiency under the following conditions.

| Test conditions | |
|---|---|
| Machine | Cam plast meter (35 tons) |
| Test piece | Aluminum (5052, 20 cm in outer diameter, 8.5 mm in inner diameter, 7.0 mm in height) |
| Processing rate | 5.6 mm/sec |
| Processing temperature | 480° C. |
| Processing degree | The test piece was pressed to reduce the height by 40%. |

Figure 2:
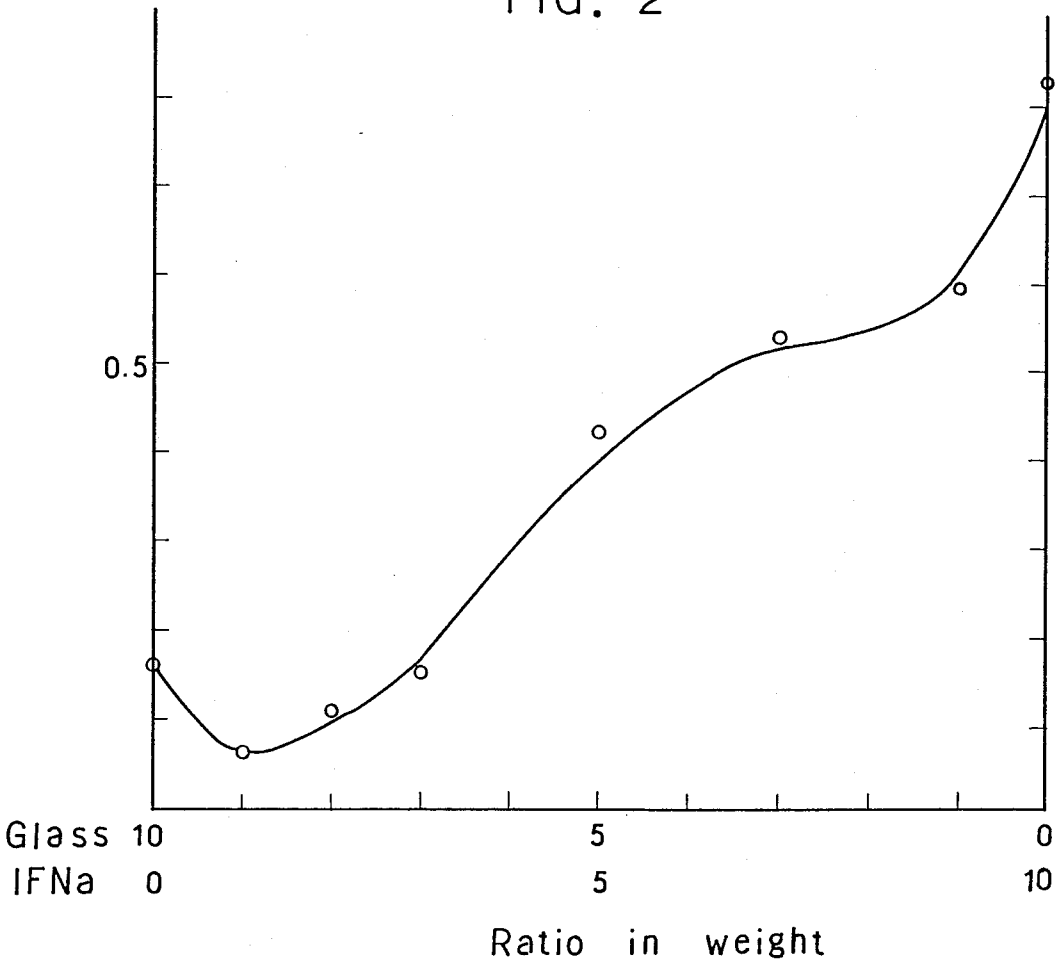

FIG. 2 reveals that the presence of sodium isophthalate leads to the rise of friction coefficient, particularly its sharp rise in case of about 90% by weight. Consequently the lubricant composition of the present invention preferably comprises about 10 to about 90% by weight of the glass composition and about 90 to about 10% by weight of alkali metal salt of phthalic acid. From the results shown in FIGS. 1 and 2, it is concluded that a lubricant comprising about 10 to about 40% by weight of the glass composition and about 90 to 60% by weight of alkali metal salt of phthalic acid is especially useful for metal working with a higher degree of processing.

EXAMPLE 3

The procedure of Example 1 was followed to produce an aqueous lubricant composition of the invention comprising 12% by weight of sodium isophthalate and 3.5% by weight of the glass composition. The lubricant was diluted 5 folds and used in the production of wheel mesh of car.

| Test conditions | |
|---|---|
| Forging Machine | Forging press (5000 tons) |
| Test piece | AA6061 heated to 450° C. |
| Die temperature | 200° C. |
| Forging pressure | 3800 tons |

No defects were found even after 1000 shots with good lublicity and releasability.

When an aqueous solution of sodium isophthalate (2.4 wt. %) was used as a lubricant, test pieces stuck to the die only after 3 to 10 shots.

When an aqueous solution of the same glass composition (0.7 wt. %) was used as a lubricant, the glass unevenly accumulated on the die and started to damage the products after 12 shots.

EXAMPLE 4

The lubricant composition obtained in Example 3 was used for the production of wheel ring of car under the following conditions.

| | |
|---|---|
| Machine used | 5000-ton press |
| Material used | AA6051 heated to 480° C. |
| Temperature of die | 200° C. |
| Forging pressure | 3800 tons |

Processing was continued smoothly even after 1000 shots.

When an aqueous solution containing 2.4% by weight of sodium isophthalate was used as lubricant, only damaged product is formed with each shot.

EXAMPLE 5

Glass composition comprising 58.5% by weight of $P_2O_5$, 5% by weight of $B_2O_3$, 24% by weight of $Na_2O$ and 11.5% by weight of $K_2O$ was dissolved in water to prepare an aqueous solution having a concentration of 10% by weight.

Sodium isophthalate was dissolved in water to prepare an aqueous solution having a concentration of 10% by weight.

The two solutions and a mixture of the two solutions were diluted 80 folds and tested for properties under the following conditions.

| Test conditions | |
|---|---|
| Machine | Diecast machine (350 tons) |
| Test piece | Aluminum sheet (ADC10, 20 cm × 15 cm × 6 mm) |
| Die temperature | 200 to 230° C. |

Each lubricant was applied to the test piece with a hand spraying gun.

Table 2 below shows the component remaining adhered to the die after release of the molded product (adhered component), releasability and lubricity of the lubricants which were evaluated in a manner as described below by the following ratings:

Adhered component; the lubricant was observed with the unaided eye to check if any component remained adhered to the surface of the die.

Releasability; when released from the mold, the molded product was rated (B) which permitted the extrusion pin to produce a loud noise, whereas the molded product was rated (A) which entailed a lesser noise of the extrusion pin.

Lubricity; When the speed of plunger was elevated, the molded product was rated (A) which involved no galling of the biscuit portion nor seizure of the gate portion, whereas the molded product was rated (B) which involved such galling and seizure.

Table 2 also indicates the result of lubricant consisting of glass or sodium isophthalate alone for comparison.

TABLE 2

| | Adhered component | Releasability | Lubricitry |
|---|---|---|---|
| Lubricant consisting of glass | None | B | B |
| Lubricant consisting of sodium isophthalate | None | B | B |
| Lubricant comprising a 1:1 mixture of glass and sodium isophthalate | None | A | A |

EXAMPLE 6

Two hundred parts by weight of potassium isophthalate and 2 parts by weight of natural rubber were mixed with 28.8 parts by weight of potassium metaphosphate, 59.2 parts by weight of sodium metaphosphate, 6.5 parts by weight of sodium carbonate and 7.2 parts by weight of borax in proportions, calculated as oxides, 58.5% by weight of $P_2O_5$, by weight of $B_2O_3$, 24% by weight of $Na_2O$ and 11.5% by weight of $K_2O$, and the mixture was pulverized to particles of 200 mesh or less to produce a lubricant composition. The lubricant composition thus prepared was tested for properties under the following conditions.

| Test conditions | |
|---|---|
| Forging machine | Forging press (1600 tons) |
| Test piece | Ball nut |
| Material-heating temperature | 1200 to 1250° C. |
| Material | SKD 61 |
| Die temperature | 200 to 300° C. |

Application of composition: Scattered over the upper and lower dies

Test results: The forging was obtained free of indentation due to accumulation of the composition and seizure and without entailing wear on the dies.

EXAMPLE 7

One hundred parts by weight of sodium metaphosphate (calculated as oxides, 69.6% by weight of $P_2O_5$ and 30.4% by weight of $Na_2O$), 100 parts by weight of lithium isophthalate and 2 parts by weight of polyvinyl alcohol were dissolved in 1000 parts by weight of water, giving a lubricant composition, which was tested for properties under the following conditions.

| Test conditions | |
|---|---|
| Forging machine | Drop hammer (5 tons) |
| Test piece | Connectinhg rod |
| Material-heating temperature | 1370 to 1380° C. |
| Working temperature | 1270 to 1280° C. |
| Die temperature | 200° C. |
| Material | SCM-3 |
| Dilution | 10-fold |

Application of composition: Uniformly applied to the lower and upper dies by a hand sprayer Test results: The composition entailed no environmental trouble, permitted no indentation due to accumulation nor seizure, and enabled smooth operation with good lubrication and release.

EXAMPLE 8

A square plate (40 mm in length and width and 10 mm in thickness) made of a steel alloy (SKD-61) was used as a test sample. Tests were conducted in the manner as described hereinafter by use of six kinds of lubricant compositions shown below in Table 3. The test sample was placed on an iron plate heated to 400° C. by a burner and indirectly heated thereon. The surface of the test sample was polished before each application of the lubricant compositions with sandpaper (cc1000-cw). Each composition (5% by weight of solid content) was applied by a brush to the test sample with its surface at 180° to 200° C. Then the test sample was heated to 300° C., immersed in water to chill the surface and heated again in hot water having a temperature of 100° C. for 30 minutes. The series of procedures of heating, immersion and reheating was repeated 5, 10 and 15 times, respectively to measure the weight loss of the test sample. The composition was applied to an area of 13.85 $cm^2$ on the test sample.

TABLE 3

| Lubricant Comp. | Aq. sol. of glass | Aq. sol. of sodium isophthalate |
|---|---|---|
| A | 10 | — |
| B | — | 10 |
| C | 4.5 | 5.5 |
| D | 3.6 | 6.4 |
| E | 2.9 | 7.1 |
| F | 2.2 | 7.8 |

The values in Table 3 show the amounts of the materials in terms of part by weight, calculated as solids. The glass comprises 57.1% by weight of $P_2O_5$, 4.8% by weight of $B_2O_3$, 18.1% by weight of $Na_2O$ and 20.0% by weight of $K_2O$.

Test results: The weight loss of the test sample is graphed in FIG. 3 in which A to F refers to lubricant compositions A to F.

Figure 3:
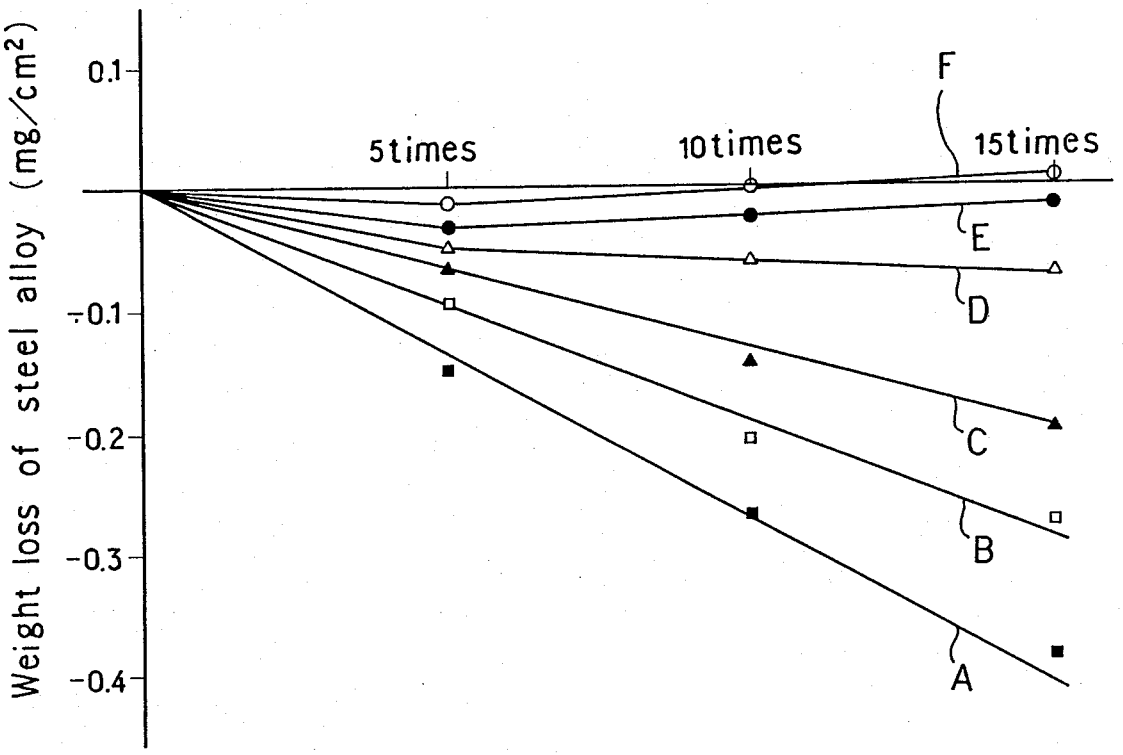

FIG. 3 reveals that the lubricant compositions of the present invention (C to F) effectively prevent the wear of the die.

EXAMPLE 9

Phosphoric acid, sodium carbonate, potassium carbonate and boric acid were mixed together in proportions, calculated as solids, of 57.1% by weight of $P_2O_5$, 4.8% by weight of $B_2O_3$, 18.1% by weight of $Na_2O$ and 20.0% by weight of $K_2O$, and the mixture was heated to 900° C. for 30 minutes for melting and vitrified. The glass thus obtained was dissolved in water to obtain an aqueous solution having a concentration of 30% by weight. Aside from the above, sodium orthophthalate was dissolved in water to obtain an aqueous solution having a concentration of 20% by weight. Vinyl acetate was used as adhesive material.

A lubricant composition was prepared by using 2.4 parts by weight of the glass, 14 parts by weight of sodium orthophthalate, 3 parts by weight of vinyl acetate, calculated as solids, and 80.6 parts by weight of water and was tested for properties under the following conditions.

| Test conditions | |
|---|---|
| Forging machine | AJAX (hydraulic type, 6000 tons) |
| Test piece | Crank shaft |
| Material-heating temperature | 1100 to 1200° C. |
| Working temperature | 900 to 1000° C. |
| Die temperature | 150 to 200° C. |
| Material | S-53 C |
| Dilution | 10-fold |

Application of composition: Uniformly applied to the lower and upper dies by a hand spray Test results: The composition entailed no seizure or indentation due to accumulation and enabled smooth operation with good lubrication and release under excellent operation environments.

EXAMPLE 10

Phosphoric acid, sodium carbonate, potassium carbonate and boric acid were mixed together in proportions, calculated as oxides, of 58.5% by weight of $P_2O_5$, 5% by weight of $B_2O_3$, 24% by weight of $Na_2O$ and 11.5% by weight of $K_2O$, and the mixture was heated to 900° C. for 30 minutes for melting and vitrified. The glass obtained was dissolved in water to produce an aqueous solution having a concentration of 30% by weight. Aside from the above, sodium isophthalate was dissolved in water to obtain an aqueous solution having a concentration of 20% by weight.

A lubricant composition was prepared by using 4 parts by weight of the glass, 10 parts by weight of sodium terephthalate, calculated as solids, and 86 parts by weight of water and was subjected to test under the following conditions.

| Test conditions | |
|---|---|
| Forging machine | AJAX (hydraulic type, 6000 tons) |
| Test piece | Crank shaft |
| Material-heating temperature | 1100 to 1200° C. |
| Working temperature | 900 to 1000° C. |
| Die temperature | 100 to 130° C. |
| Material | S-53 C |
| Dilution | 20-fold |

Application of composition: Uniformly applied to the lower and upper dies by a hand spray Test results: The composition entailed no seizure or indentation due to accumulation and enabled smooth operation with good lubrication and release for 180 shots.

EXAMPLE 11

Phosphoric acid, potassium carbonate and boric acid were mixed together in proportions, calculated as solids, of 23.4% by weight of $P_2O_5$, 53.2% by weight of $B_2O_3$, 23.4% by weight of $K_2O$, and the mixture was heated to 900° C. for 30 minutes for melting and vitrified. The glass thus obtained was dissolved in water to obtain an aqueous solution having a concentration of 30% by weight. Aside from the above, sodium isophthalate and potassium orthophthalate were dissolved respectively in water to obtain aqueous solutions, the former having a concentration of 15% by weight and the latter having a concentration of 5% by weight. Vinyl acetate was used as adhesive material.

A lubricant composition was prepared by using 2.4 parts by weight of the glass, 10.5 parts by weight of sodium isophthalate, 3.5 parts by weight of potassium orthophthalate, 2 parts by weight of vinyl acetate, calculated as solids, and 81.6 parts by weight of water and was tested for properties under the following conditions.

| Test conditions | |
|---|---|
| Machine | EUMUCO press (3150 tons) |
| Test piece | Connecting rod |
| Material-heating temperature | 1000 to 1100° C. |
| Working temperature | 900 to 1000° C. |
| Die temperature | 170 to 220° C. |
| Material | S-55 C |
| Dilution | 25-fold |
| Test results | 800 shots were smoothly carried out without entailing seizure. |

We claim:

1. A lubricant composition for metalworking which comprises as its active components (i) at least one alkali metal salt of phthalic acid and (ii) a glass composition comprising 20 to 70% by weight of $P_2O_5$ and 8 to 80% by weight of $M_2O$ wherein M is an alkali metal the ratio of component (i) to component (ii) being about 10:90 to about 90:10 in a total amount of 100 parts by weight.

2. A lubricant composition as defined in claim 1 wherein the glass composition comprises 55 to 65% by weight of $P_2O_5$ and 25 to 45% by weight of $M_2O$.

3. A lubricant composition as defined in claim 1 wherein the amount of component (i) is about 60 to about 90 parts by weight per 100 parts by weight of the active components.

4. A lubricant composition as defined in claim 1 wherein the component (i) is at least one of sodium phthalate, sodium isophthalate, sodium orthophthalate and sodium terephthalate.

5. A lubricant composition as defined in claim 1 which further comprises an adhesive material.

6. A lubricant composition as defined in claim 1 wherein the glass composition also comprises 3 to 72% by weight of $B_2O_3$.

7. A lubricant composition as defined in claim 6 wherein the amount of component (i) is about 60 to about 90 parts by weight per 100 parts by weight of the active components.

8. A lubricant composition as defined in claim 6 wherein the component (i) is at least one of sodium phthalate, sodium isophthalate, sodium orthophthalate and sodium terephthalate.

9. A lubricant composition as defined in claim 6 which further comprises an adhesive material.

* * * * *